US006786519B2

(12) United States Patent
Gartner

(10) Patent No.: US 6,786,519 B2
(45) Date of Patent: Sep. 7, 2004

(54) SWING BOLT LOCK WITH IMPROVED TAMPER RESISTANCE AND METHOD OF OPERATION

(75) Inventor: Klaus W. Gartner, Palos Verdes Estates, CA (US)

(73) Assignee: U-Code, Inc., Torrance, CA (US)

( * ) Notice: Subject to any disclaimer, the term of this patent is extended or adjusted under 35 U.S.C. 154(b) by 0 days.

(21) Appl. No.: 10/041,811

(22) Filed: Jan. 7, 2002

(65) Prior Publication Data

US 2003/0127865 A1 Jul. 10, 2003

(51) Int. Cl.[7] ..... E05C 3/06
(52) U.S. Cl. ..... 292/195; 70/422; 109/59 R
(58) Field of Search ..... 292/195; 74/599; 70/210, 422; 109/59 R, 59 T

(56) References Cited

U.S. PATENT DOCUMENTS 2,653,045 A 9/1953 Pinderhughes
4,032,729 A 6/1977 Koistinen
4,106,316 A * 8/1978 Tippin ..... 70/268
4,714,030 A * 12/1987 Cole ..... 109/61
4,770,012 A 9/1988 Johansson
4,901,545 A 2/1990 Bacon et al.
5,134,870 A * 8/1992 Uyeda ..... 70/277
5,142,890 A * 9/1992 Uyeda ..... 70/277
5,340,173 A 8/1994 Bethel
5,887,467 A 3/1999 Butterweck et al.

* cited by examiner

*Primary Examiner*—Gary Estremsky
(74) *Attorney, Agent, or Firm*—Barbara A. Wrigley; Oppenheimer Wolff & Donnelly LLP

(57) ABSTRACT

The locking bolt of a swing bolt lock has an elongated opening that fits on a shaft in the lock's housing. The shaft has a compression spring that biases the bolt toward one side of the shaft. In normal operation, the compression spring urges the bolt such that the shaft is at one end of the elongated opening. There, the swing bolt pivots about the shaft to unlock the lock. When a person tries to force the lock, the elongated opening of the bolt moves against spring bias along the shaft. In one embodiment, flat surfaces in the opening and on the shaft engage each other and a notch on the outside surface of the bolt engages a stationary safety key. This prevents the bolt from applying sufficient force to break weaker parts within the lock mechanism and force the lock open.

23 Claims, 2 Drawing Sheets

SWING BOLT LOCK WITH IMPROVED TAMPER RESISTANCE AND METHOD OF OPERATION

BACKGROUND OF THE INVENTION

1. Field of the Invention

The present invention relates to swing or rotary bolt locks in which part of the locking bolt pivots into and out of the lock housing.

2. General Background and State of the Art

Doors of safes, vaults, strong rooms, container and similar security closures (collectively called "safes" in this application) usually have at least one and preferably several safe bolts that reciprocate from a non-locking position to an extended locking position. In the locking position, the safe bolts extend from the safe door into receptacles in the adjacent safe walls. When the safe has more than one bolt, bolt works connect the bolts. The bolt works include linkages that move the safe bolts simultaneously when a user turns a single handle. A locking device cooperates with the bolt works to secure the safe bolts in their extended locking position.

So-called swing bolt or rotary bolt locking devices mount a bolt for pivoting between locked and unlocked positions. This application refers to the swing bolt within the locking device as the "bolt," "swing bolt" or "locking bolt." The bolts that secure the safe door to the rest of the safe are called "safe bolts." In the locked position, part of the locking bolt projects out of the housing. Through the swing bolt's intersection with the mechanical bolt works when the swing bolt is in its locked position, the bolt works cannot move the safe bolts to their unlocked position. When the user enters the correct combination, the lock mechanism allows the locking bolt to pivot so that it is within the housing.

A handle on the outside of the safe connects to the bolt works. Pivoting the handle initiates movement of the bolt works. If the user enters the correct combination so that the locking bolt is not locked, the bolt works can pivot the swing bolt so that the swing bolt does not project from the housing. This is the unlocked position, which permits the bolt works to continue moving the safe bolts to their unlocked condition. That allows one to open the safe. If, however, the swing bolt is locked, the swing bolt blocks movement of the bolt works. That prevents the bolt works from withdrawing the safe bolts. Uyeda, U.S. Pat. Nos. 5,134,870 (1992) and 5,142,890 (1992), describe safes using swing bolt locks.

The locking mechanism within the lock housing blocks the bolt from pivoting to the unlocked position. The two Uyeda patents and other prior art locks have a solenoid within the housing. In the Uyeda patent, the solenoid plunger directly engages the locking bolt. The solenoid plunger of other prior art locks engages a locking plate that projects against the bolt. When the plunger or plate engages the bolt, the bolt normally cannot rotate to an unlocked position.

An electronic combination entry system controls the solenoid. Typically, the user enters the combination through a digital input pad. Butterwerk, U.S. Pat. No. 5,887,467 (1999), "Pawl and Solenoid Locking Mechanism," is an example of a lock that uses a key pad on a rotary handle. Rotary input through a dial also can generate an output. Internal circuitry senses entry of the correct combination and sends an electric signal to the solenoid. The signal causes the solenoid to withdraw the plunger, which, in turn, allows the locking plate to disengage the locking bolt. The handle then can manipulate the bolt works. Part of the bolt works pushes on the locking bolt to rotate the bolt about a shaft to its unlocked position. The bolt works then withdraw the safe bolts.

The prior art recognizes that applying sufficient force on a still-locked handle of a safe with a swing bolt lock through pounding, jostling or other manipulation can sometimes open the safe. The solenoid must be relatively small to fit within the lock housing. Therefore, the plunger also is small and weak. Further, having a smaller solenoid consumes less electric power. Since most such locks are battery-powered, decreasing electric consumption adds to battery life. Unfortunately, sufficient force from the handle through the bolt works against the swing bolt sometimes can apply enough force against the locking plate to break the plunger. Once the plunger breaks, the plate moves freely, which allows the swing bolt to pivot open. The bolt works are free to withdraw the safe bolts from their receptacle to open the safe.

The Uyeda patents and other prior art locks propose a solution to this problem. When one tries to rotate the handle without first entering the correct combination, the bolt pushes against the solenoid housing or the locking plate. The Uyeda patents have a notch in the periphery of the rotary bolt. The bore of the swing bolt, which rotates about a shaft or axle, is elongated. The elongated opening can move along the bore when one applies a force form the handle through the bolt works on the swing bolt. Thus, the swing bolt can move laterally. Lateral movement causes the notch on the periphery of the swing bolt to engage a safety key within the lock housing. That prevents further force from the swing bolt against the solenoid plunger or locking plate. The Uyeda patents also have a leaf spring that biases the swing bolt and its bore to a normal position relative to the shaft within the bore.

The mechanism in the Uyeda patents is complex and costly to build and assemble. Other prior art has simplified the mechanism, but the structure to bias the swing bolt relative to its shaft or axle has remained complex. For example, one swing bolt has a bolt plate mounted in a groove in the swing bolt. That plate has an opening over part of the elongated opening in the swing bolt. A spring within the bolt biases the opening in the plate to one end of the elongated opening. When force is applied to the bolt to cause it to pivot about the solenoid locking plate, the bolt plate slides on the bolt against the spring until the opening in the bolt plate is at the other end of the elongated opening in the swing bolt. That shifts the swing bolt sufficiently to case the notch of the periphery of the swing bolt to engage the key in the lock housing. The construction of the swing bolt with its sliding plate and internal spring is complex. Assembly costs are high and time consuming.

INVENTION SUMMARY

An object of the present invention is to disclose a pivoting or swing bolt lock that prevents the bolt from pivoting except when the user enters the correct combination. Specifically, an object of the present invention is to disclose a lock that prevents a thief or other unauthorized user from supplying sufficient force to the outside handle to break internal parts of the lock to gain access to a safe. Providing that object with few parts that can be assembled easily and efficiently is another object of this invention.

The present invention includes a housing having a bolt opening into and out of which a rotating or swing locking bolt pivots. The swing bolt has an elongated opening for receiving the shaft.

A solenoid mounts within the housing. A plunger on the solenoid engages a locking plate. When the lock is in its locked condition, the locking plate engages the locking bolt to prevent the swing bolt from pivoting. When a user enters the correct combination, the plunger disengages the locking plate so that the latter is free to slide out of its engagement with the locking bolt. A handle connected by a shaft through the outside of the safe drives bolt works. Movement of bolt works acts on the swing bolt and pivots it to the unlocked position. Because the locking plate is out of the way, it does not prevent the swing bolt from pivoting.

If an unauthorized user applies sufficient force to the handle through the bolt works against the swing bolt, the intersection of the swing bolt and the locking plate becomes an axis of rotation. The swing bolt rotates slightly on that axis because the opening in the swing bolt through which the shaft extends is elongated. This permits some lateral movement of the swing bolt relative to the shaft. As a result, a notch on the swing bolt periphery engages a safety key or other part of the housing, a part that the swing bolt would miss if the bolt were rotated properly with the locking plate out of the way.

The shaft has a generally flattened surface, and one end of the shaft-receiving opening that faces the flattened face of the shaft also is generally flat. By "flat," applicant means that generally cylindrical surfaces are flattened. They need not be actually flat. Further, though the exemplary embodiment shows the entire height of the opening and the shaft being flattened, one could flatten parts of the surfaces.

The shaft has a bore on the flattened surface that receives a compression spring. The spring extends from the shaft to the flattened surface of the opening. The spring retains the locking bolt in its normal position on the shaft unless forces caused when one tries to open the lock forcibly overcomes the spring force.

BRIEF DESCRIPTION OF THE DRAWINGS

FIG. 4 shows the swing bolt in the locked position. FIG. 5 shows the bolt being blocked from moving to the unlocked position, and FIG. 6 shows the swing bolt in the unlocked position.

DETAILED DESCRIPTION OF THE PREFERRED EMBODIMENTS

Figure 2:
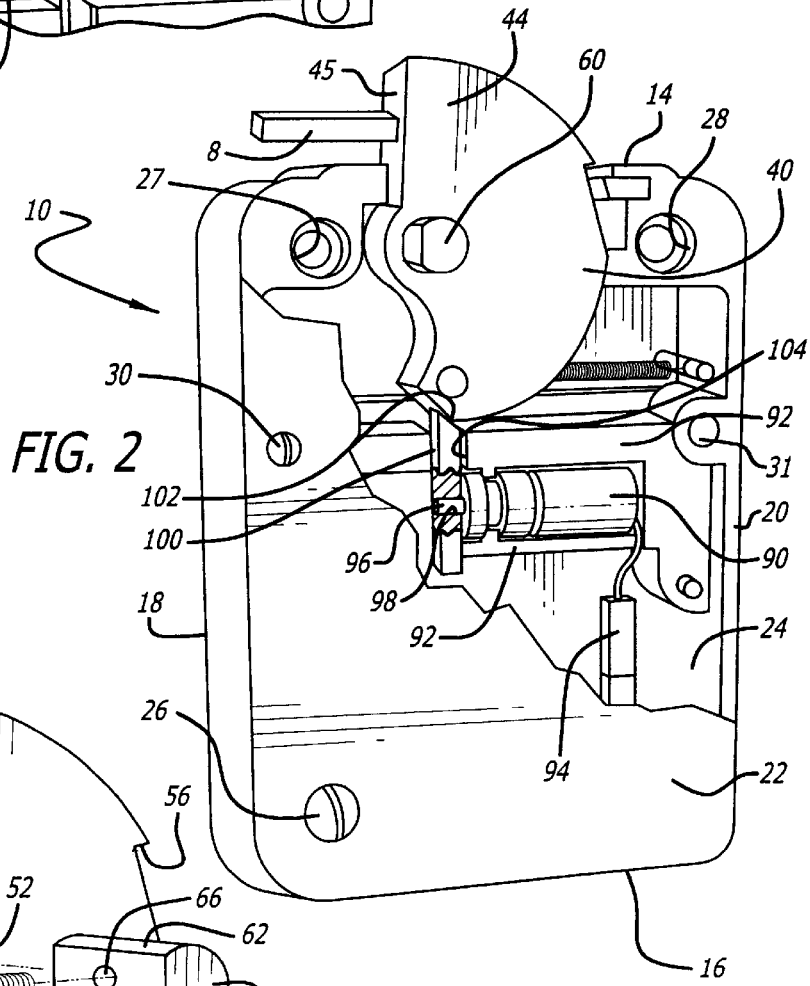
FIG. 2 is a perspective view, partially cut away, of an exemplary embodiment of the swing bolt lock of the present invention.
Figure 3:
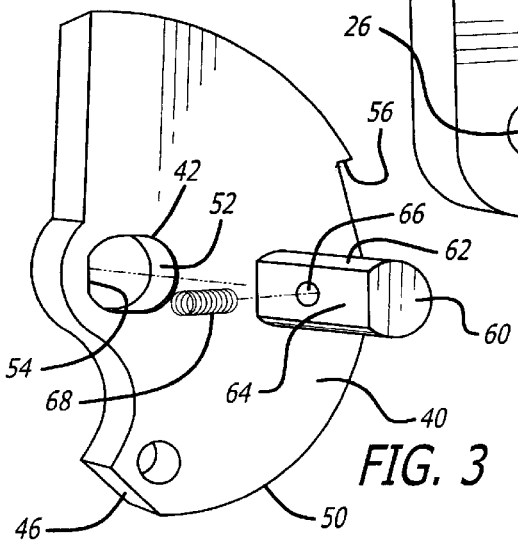
FIG. 3 is a perspective view of an exemplary embodiment of the swing bolt used in the lock of the present invention.

The locking mechanism of lock 10 of the exemplary embodiment of the present invention mounts within case or housing 12 (FIG. 2). The housing is commonly brass or other reasonably hard, nonmagnetic metal that can be cast. The housing has a top and bottom 14 and 16 and two sides 18 and 20. The use of "top," "bottom" and sides" relates to the lock's orientation in the drawings. Each side could become a top or bottom depending on the lock's orientation in its safe. As FIG. 2 shows, the housing is rectangular with curved corners, a common, standard-shaped housing. The size of the housing is standardized and is 3¼ in.×2 in. (8.2 cm×5.9 cm). Metric equivalents are approximate and rounded.

The rear wall 24 attaches to the door of a safe or other secure container. The front wall or cover 22 is a plate that is removable from the housing for repairing the lock. Three bolts (only one, bolt 26, shown) extend through openings such as openings 27 and 28 in the rear wall and are threaded into threaded openings in the door of the safe. Thus, the bolts secure the lock to a safe. The spacing of the openings 27 and 28 are standardized by different safe manufacturers so that manufacturers' locks are compatible with the safes. The distance between the opening 27 and the opening through which bolt 26 extends is 2 in. (6.7 cm), and the distance between opening 27 and 28 is 1 in. (4.1 cm). Smaller bolts 30 are threaded into openings 31 (FIG. 2) and secure cover 22 to the rest of the housing.

Figure 4:
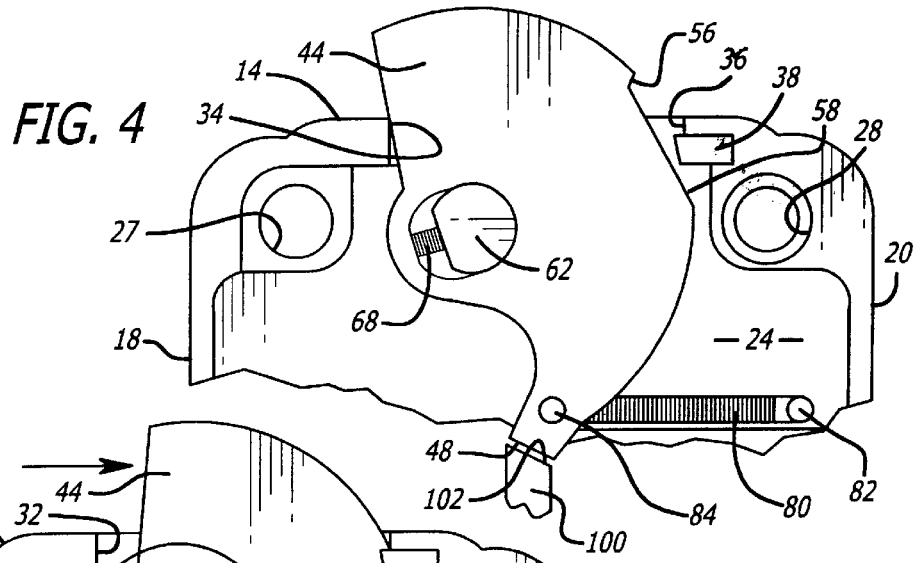
FIGS. 4, 5 and 6 are plan views of a portions of an exemplary embodiment of the swing bolt lock of the present invention.
Figure 5:
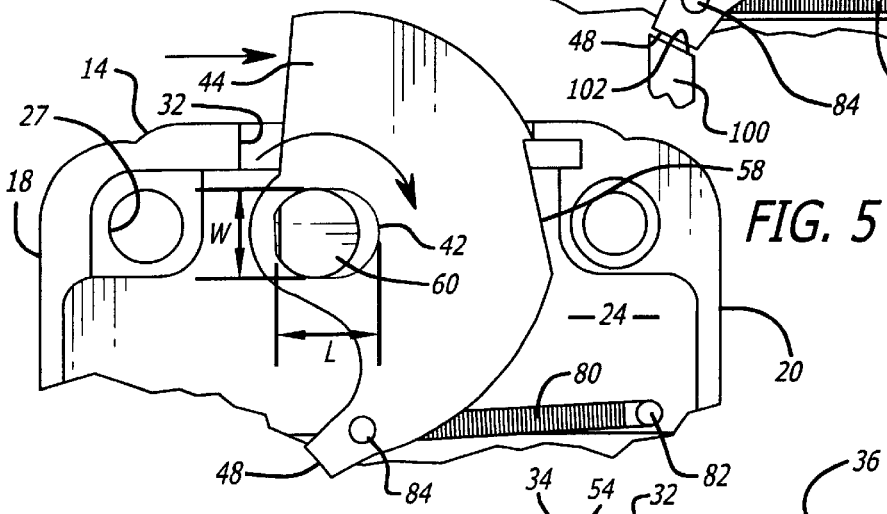

A locking bolt mounts in housing 12. In the exemplary embodiment, locking bolt 40 has a semicircular-like shape (FIGS. 2–6). A shaft receiving opening 42 is at the center of the semicircle. The opening is rounded at one end but is not round. It is elongated; the width dimension W is less than the length dimension L (FIG. 5). A shaft or axle mounts within the housing. In the exemplary embodiment, shaft 60 mounts in a sleeve (not shown) and extends out from the housing's rear wall. The opening that receives the shaft is formed during the housing's casting process.

Figure 6:
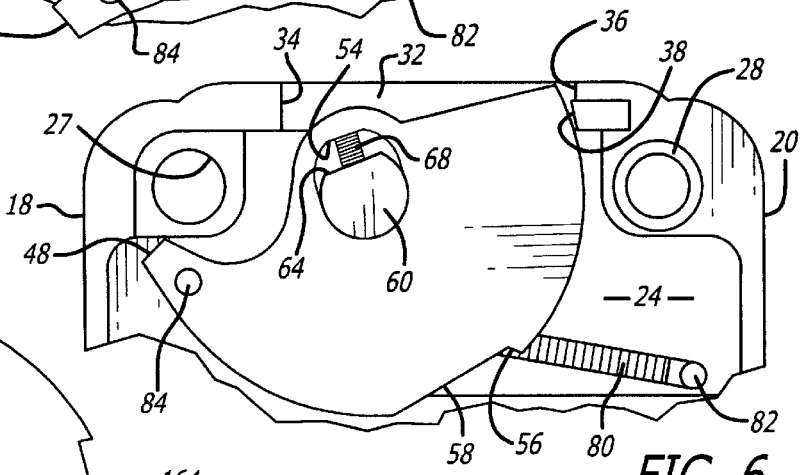

Opening 42 of bolt 40 fits on shaft 60. The bolt, therefore, can pivot about the shaft. The bolt position that FIGS. 2 and 4 show is the locked position. In that position, extended portion 44 of the bolt extends outside locking bolt opening 32. The locking bolt opening is an indentation in the top wall 14 of the housing (FIGS. 4–6) that is formed when the housing is cast. The opening extends from side walls 34 and 36 in the housing. The cover 22 may have a narrow flange (not shown) that extends into the opening. The bolt pivots to an unlocked position in which the bolt's extended portion 44 is within the housing. FIG. 6.

A return spring 80 stretches from a pin 82 that extends upward from the rear wall 24 of the housing (FIGS. 4–6) to a small opening 84 on the inside portion 86 of bolt 40. Instead of attaching the spring directly to opening 84, the opening could mount a pin, and spring 80 could attach to the pin. Tension from spring 80 urges the bolt counterclockwise with the extended portion 44 of the bolt in its locked position.

A handle has a shaft (the drawings show neither) that extends through the door of the safe to the bolt works. Pivoting the handle to an unlocked position manipulates the bolt works. One arm 8 (FIG. 2.) of the bolt works is in contact with camming surface 45 of the locking bolt. Movement of arm 8 to the right (FIG. 2) pivots the locking bolt 40 to the unlocked position. The handle may be separate from the combination entry device per Uyeda, U.S. Pat. No. 5,142,890, or the combination entry may mount on the handle per Gartner, application Ser. No. 09/664,265, "Combination Lock Handle." Both are incorporated by reference.

An actuator mounts inside the housing. In the exemplary embodiment, the actuator includes solenoid 90 (FIG. 2). The solenoid mounts in a cavity 92 within the housing. Walls extending upward from rear wall 24 form the cavity. The walls are part of the casting that forms the housing. Circuitry within circuit board 94 cooperates with the combination entry device. When the user enters the correct combination, the circuitry signals the solenoid 90 to withdraw plunger 96 from opening 98 in locking plate 100. Though the exemplary embodiment uses a solenoid, a linear electromagnetic device, the lock could use a motor or other rotary electromagnetic device.

The walls that form the cavity 92 for the solenoid also form a cavity 104 for the locking plate 100. The locking plate can slide toward and away from locking bolt 40 within its cavity 104. A small spring (not shown) biases the locking plate toward the bolt. When the solenoid plunger 96 is within opening 98 in locking plate 100, angled face 102 of the locking plate is against the bolt 40 (FIGS. 2, 4 and 5). The bolt may have a flat region 48 (FIG. 3) along part of the outside surface 50 of the bolt. The angled face 102 normally rests against the flat region 48.

When, after entry of the correct combination, solenoid 90 withdraws plunger 96 from opening 98, locking plate 100 is free to slide away from locking bolt 40. If the user rotates the handle to cause the bolt works to rotate the locking bolt, the bolt's curved surface 50 cams the locking plate downward (in FIG. 2). With the locking plate out of engagement with the locking bolt, the bolt pivots to the unlocked position (FIG. 6). When the solenoid ceases to receive a signal, the solenoid releases the plunger. Because the plunger is spring biased outward, it will return to opening 98 in locking plate 100 when the locking bolt pushes the locking plate to its bottom-most position. If the locking plate is not at that position, the plunger contacts the locking plate and remains in contact until the locking bolt pushes the locking plate to that position.

If the user fails to enter the correct combination, the solenoid plunger 96 remains in opening 98 of locking plate 100. Attempting to rotate the handle and the bolt 40 causes the bolt to push against the locking plate. Because the locking plate does not move, the locking plate prevents the bolt from rotating. See FIG. 2. An authorized user then will reenter the correct combination. One who merely is curious to see if the safe is open will walk away once the handle does not move. However, a person determined to break into the safe may try to rotate the handle forcibly.

As previously discussed, the solenoid plunger usually is relatively small and weak. If the person breaking into the safe applies sufficient force to the locking bolt, the bolt can push the locking plate with enough force against the solenoid plunger to break the plunger. The plate now can move freely to allow the bolt to pivot open so the bolt works can withdraw the safe bolts to open the safe.

The design of the shaft 60 and the shaft receiving opening 42 prevents the forcible opening of the lock. Shaft 60 is cylindrical (round) over most of its circumference. In the exemplary embodiment, the round portion 62 is about ¾ of the circumference. The remaining part 64 is flattened. Likewise, opening 42 in the locking bolt has a rounded region 52 and is elongated (FIGS. 3–6). The side opposite the rounded region also is flattened. The elongation of opening 42 in the L direction (FIG. 5) permits the locking bolt 40 to translate in that direction.

Shaft 60 has an opening 66 in flat face 64 that receives a compression spring 68. The compression spring pushes against the flattened region 54 of opening 42. Thus, the spring urges the locking bolt so that the round portion 62 of the shaft is against the round portion 52 of opening 42. See FIGS. 4 and 6.

Surface 54 is flattened to secure compression spring 68 and prevent the spring from slipping. Likewise, the flattened surface 68 of the shaft mates with the flattened surface 54 of the opening when the two flattened surfaces move together. The mating of the two flattened surfaces also prevent rotation of the locking bolt on the shaft.

Figure 7:
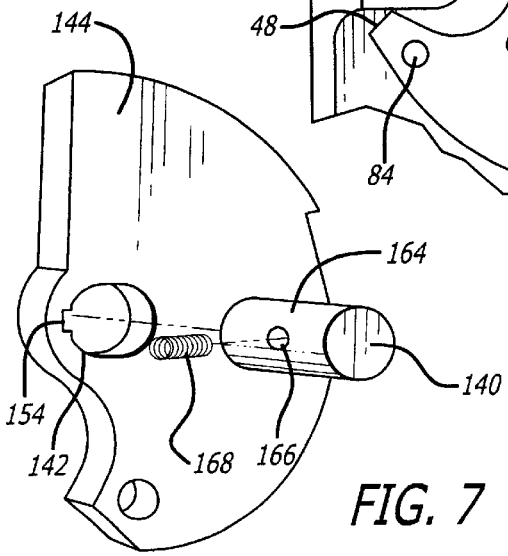
FIG. 7 is an alternate embodiment of the swing bolt used in the lock of the present invention.

In another exemplary embodiment (FIG. 7), shaft 160 is cylindrical. An opening 166 in face 164 of shaft 160 receives compression spring 168. Opening 142 in bolt 144 has a grove 154 that is slightly wider than the diameter of spring 168. The compression spring pushes against the end of the groove 154. The groove acts to trap the spring and prevent the spring from slipping and prevents rotation of the locking bolt on the shaft.

If the user attempts to force the locking bolt open, he or she applies a force through the arm 8 of the bolt works on locking bolt 40. Because the correct combination has not been entered, locking plate 100 remains in contact with the locking bolt. The force from the handle applies a clockwise torque on the locking bolt about the bolt's point of contact with locking plate 100. The torque cause a force from the locking bolt on the shaft. The force is in the direction of the elongation of opening 42 and is against the force from the compression spring. Consequently, the flattened side 54 of the opening moves toward the flattened region 64 of the shaft (FIG. 5).

As FIG. 5 shows, the locking bolt 40 moves to the right sufficiently so that surface 50 of the locking bolt engages stop member or safety key 38. The locking bolt surface has a notch 56 and ramp 58 that engage the safety key. The safety key is steel in the exemplary embodiment because steel is stronger than the brass housing and can resist force from the locking bolt better. Depending on the maximum forces, however, the safety key may be part of the cast brass housing.

When notch 56 engages stop 38, the locking bolt can rotate clockwise no farther. As FIG. 5 shows, the bolt remains in that position. This limits the force that the bolt applies on the locking plate 100. Consequently, the bolt does not apply enough force to the locking plate to break the solenoid plunger 96. The person who tries to force the lock, therefore, neither can rotate the locking bolt to the open position nor cause the bolt works to withdraw the safe locks to gain entry to the safe.

Figure 1:
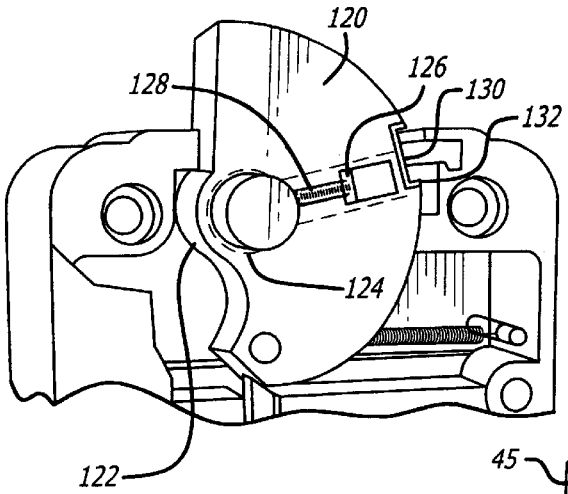
FIG. 1 PRIOR ART
FIG. 1 is a partial perspective view of the swing bolt of a prior art lock

Prior art swing bolts were more complex. For example, one swing bolt 120 (FIG. 1) has a bolt plate 122 mounted in a groove in the swing bolt. The bolt has an opening 124 over part of the elongated opening in the swing bolt. The end 126 hooks into the groove. Spring 128 in the groove biases the bolt plate and the plate's opening to one end of the elongated opening. When force is applied to the bolt to cause it to pivot about the solenoid locking plate, bolt plate 128 translates against the spring until the opening in the bolt plate is at the other end of the elongated opening in the swing bolt. That shifts the swing bolt sufficiently so that the notch 130 along the periphery of the swing bolt engages the safety key in the lock housing.

Note that notch 130 has a steel liner. The liner strengthens the notch. Such an arrangement could replace the notch 56 and ramp 58 design in the exemplary embodiment (FIG. 5).

Assembly of the present invention is less complex than assembly of prior art locks. This is one of the advantages of this invention. The assembler inserts compression spring 68 into opening 66 in shaft 60. He or she can compress the spring sufficiently to insert the opening 42 of locking bolt 40 over the shaft and compressed spring. The spring is in contact with the flattened surface 54 as the opening is inserted over the shaft. The prior art bolt of FIG. 1 requires much more complex assembly. Spring 128 must be positioned in a cavity within the bolt. The spring is then compressed to attach the locking plate in its groove.

While the specification describes particular embodiments of the present invention, those of ordinary skill can devise variations of the present invention without departing from the inventive concept.

I claim:

1. A lock comprising:

a housing having an opening for a locking bolt;

a shaft mounted in the housing, the shaft having an outside diameter;

a locking bolt having an elongated shaft having an outside diameter; the elongated opening having first and second ends, the shaft receiving opening in the locking bolt being pivotally mounted on the shaft and pivoting the locking bolt between a locked position in which the extended portion projects out of the locking bolt opening and an unlocked position in which the extended portion is within the housing;

the locking bolt having a normal position relative to the shaft in which the shaft is at the first end of the shaft receiving opening and a second position in which the shaft is at the second end of the shaft receiving opening;

an actuator in the housing having a locked condition engaging the locking bolt when the extended portion of the locking bolt is out of the locking bolt opening and movable to an unlocked condition freeing the locking bolt to pivot so that the extended portion moves into the locking bolt opening;

a safety key in the housing, the locking bolt engaging the safety key when the locking bolt is in the second position as the locking bolt moves toward the unlocked position, the locking bolt not engaging the safety key when the locking bolt is in its normal position;

a bore in the shaft;

a spring extending into the bore and projecting out of the bore, the portion of the spring extending out of the bore in contact with the second end of the shaft receiving opening.

2. The lock of claim 1 wherein the second end of the shaft receiving opening is generally flat.

3. The lock of claim 1 wherein the shaft has a generally flat surface facing the second end of the shaft receiving opening.

4. The lock of claim 3 wherein the bore extends into the generally flat surface of the shaft.

5. The lock of claim 1 wherein the second end of the shaft receiving opening has a groove extending into the shaft receiving opening.

6. The lock of claim 5 wherein the shaft has a bore facing the groove in the shaft receiving opening.

7. The lock of claim 6 wherein the spring extends between the bore and the groove.

8. A lock comprising:

a housing having an opening for a locking bolt;

a shaft mounted in the housing, the shaft having an outside diameter a locking bolt having an extended portion and a shaft receiving opening having an inward facing surface and an inside diameter larger than the outside diameter of the shaft, the shaft being received within the shaft receiving opening, wherein the locking bolt mounts on the shaft for pivoting between a locked position in which the extended portion projects out of the locking bolt opening and an unlocked position in which the extended portion is within the housing;

an actuator in the housing having a locked condition engaging the locking bolt when the extended portion of the locking bolt is out of the locking bolt opening and movable to an unlocked condition freeing the locking bolt to pivot so that the extended portion moves into the locking bolt opening;

a bore in the shaft;

a spring extending into the bore and projecting out of the bore, the portion of the spring extending out of the bore in contact with the inward facing surface of the shaft receiving opening.

9. The lock of claim 8 further comprising receiving means on the inward facing surface of the shaft receiving opening.

10. The lock of claim 8 wherein the shaft receiving opening is elongated and has two ends, one end of the shaft receiving opening having a flattened surface, the shaft being generally cylindrical with a generally flattened face, the generally flattened face facing the flattened surface of the shaft receiving opening.

11. The lock of claim 10 wherein the flattened surface of the bore is adjacent to the flattened face of the shaft.

12. The lock of claim 8 wherein the second end of the shaft receiving opening has a groove extending into the shaft receiving opening.

13. The lock of claim 12 wherein the shaft has a bore facing the groove in the shaft receiving opening.

14. The lock of claim 13 wherein the spring extends between the bore and the groove.

15. A lock comprising:

a housing having a locking bolt and a locking bolt opening;

shaft means mounted in the housing for pivotally mounting the locking bolt pivoting between a locked position in which an extended portion of the locking bolt projects out of the locking bolt opening and an unlocked position in which the extended portion is within the housing;

shaft receiving opening means in the locking bolt for receiving the shaft means and for permitting lateral movement of the shaft means along the shaft receiving opening means, the opening means having first and second ends;

bias means provided on the shaft means and extending between the shaft means and the shaft receiving opening means for biasing the first end of the shaft receiving opening means toward the shaft means.

16. A lock comprising:

a housing having a locking bolt and a locking bolt opening;

shaft means mounted in the housing for pivotally mounting the locking bolt for pivoting between a locked position in which an extended portion of the locking bolt projects out of the locking bolt opening and an unlocked position in which the extended portion is within the housing;

shaft receiving opening means in the locking bolt for receiving the shaft means and for permitting lateral movement of the shaft means along the shaft receiving opening means, the shaft receiving opening means having first and second ends;

bias means extending between the shaft means and the shaft receiving opening means for biasing the first end of the shaft receiving opening means toward the shaft means; and wherein the shaft means has a generally flat surface and the shaft receiving opening means has a generally flat surface facing the generally flat surface of the shaft means.

17. The lock of claim 16 wherein the bias means comprises a compression spring extending between the generally flat surface of the shaft means and the generally flat surface of the shaft receiving opening means.

18. A lock comprising a housing having a locking bolt and a locking bolt opening;

shaft means mounted in the housing for pivotally mounting the locking bolt for pivoting between a locked position in which an extended portion of the locking bolt projects out of the locking bolt opening and an unlocked position in which the extended portion is within the housing;

shaft receiving opening means in the locking bolt for receiving the shaft means and for permitting lateral movement of the shaft means along the shaft receiving opening means, the shaft receiving opening means having first and second ends;

bias means extending between the shaft means and the shaft receiving opening means for biasing the first end of the shaft receiving means toward the shaft means; and wherein the second end of the shaft receiving opening is generally flat.

19. A lock comprising a housing having a locking bolt and a locking bolt opening;

shaft means mounted in the housing for pivotally mounting the locking bolt for pivoting between a locked position in which an extended portion of the locking bolt projects out of the locking bolt opening and an unlocked position in which the extended portion is within the housing;

shaft receiving opening means in the locking bolt for receiving the shaft means and for permitting lateral movement of the shaft means along the shaft receiving opening means means, the shaft receiving opening means having first and second ends;

bias means extending between the shaft means and the shaft receiving opening means for biasing the first end of the shaft receiving opening means toward the shaft means; and wherein the shaft means has a generally flat surface facing the second end of the shaft receiving opening.

20. A lock of claim 19 wherein a bore extends into the generally flat surface of the shaft means.

21. A lock comprising a housing having a locking bolt and a locking bolt opening;

shaft means mounted in the housing for pivotally mounting the locking bolt for pivoting between a locked position in which an extended portion of the locking bolt projects out of the locking bolt opening and an unlocked position in which the extended portion is within the housing;

shaft receiving opening means in the locking bolt for receiving the shaft means and for permitting lateral movement of the shaft means along the shaft receiving opening means, the shaft receiving opening means having first and second ends;

bias means extending between the shaft means and the shaft receiving opening means and for permitting lateral movement of the shaft means along the shaft receiving opening means for biasing the first end of the shaft receiving opening means toward the shaft means; and there is a groove extending into the shaft receiving opening means.

22. The lock of claim 21 wherein the shaft means has a bore facing the groove in shaft receiving opening means.

23. The lock of claim 22 wherein the bias means extends between the bore and groove.

* * * * *